United States Patent [19]

Kurashima

[11] Patent Number: 5,068,594

[45] Date of Patent: Nov. 26, 1991

[54] CONSTANT VOLTAGE POWER SUPPLY FOR A PLURALITY OF CONSTANT-CURRENT SOURCES

[75] Inventor: Yasumi Kurashima, Tokyo, Japan

[73] Assignee: NEC Corporation, Tokyo, Japan

[21] Appl. No.: 664,371

[22] Filed: Mar. 4, 1991

[30] Foreign Application Priority Data

Mar. 2, 1990 [JP] Japan ..... 1-49218

[51] Int. Cl.[5] ..... G05F 3/16

[52] U.S. Cl. ..... 323/314; 323/312

[58] Field of Search ..... 323/312, 313, 314

[56] References Cited

U.S. PATENT DOCUMENTS 4,150,309 4/1979 Tokuda ..... 323/312
4,714,872 12/1987 Traa ..... 323/314
4,736,125 4/1988 Yuen ..... 323/314
4,769,589 9/1988 Rosenthal ..... 323/313
4,775,829 10/1988 Achstaetter ..... 323/313
4,970,415 11/1990 Fitzpatrick et al. ..... 323/313
4,978,904 12/1990 Fitzpatrick et al. ..... 323/313

*Primary Examiner*—Steven L. Stephan
*Assistant Examiner*—Jeffrey Sterrett
*Attorney, Agent, or Firm*—Helfgott & Karas

[57] ABSTRACT

A semiconductor integrated circuit comprises a bus line having a first node from which a power source voltage is supplied to the bus line and second nodes, constant-voltage circuits connected to the second nodes of the bus line, respectively, and a plurality of constant-current sources arranged between the constant-voltage circuits. The fist node is positioned at a middle portion between the second nodes.

9 Claims, 6 Drawing Sheets

PRIORT ART

CONSTANT VOLTAGE POWER SUPPLY FOR A PLURALITY OF CONSTANT-CURRENT SOURCES

BACKGROUND OF THE INVENTION

1. Field of the Invention

The present invention relates to a semiconductor integrated circuit having a constant-voltage circuit for supplying a constant voltage to a plurality of constant-current sources, and more particularly, to an arrangement of the constant-voltage circuit and a terminal node of a bus line from which a power source voltage is supplied to the bus line.

2. Description of Related Art

In a bipolar type semiconductor integrated circuit, a plurality of constant-current sources 2 as shown in FIG. 1 are employed, in which an NPN bipolar transistor $Q_1$ is connected at its emitter to a lower side voltage source 10 (for example, negative voltage $V_{EE}$) through a resistor $R_1$, to an input terminal 9 at its base through a resistor $R_2$ to receive a constant voltage $V_C$ to control the constant current $I_{CS}$, and to a constant-current supplying terminal 8 at its collector for supplying the constant current $I_{CS}$ to a circuit such as an emitter coupled circuit.

The constant voltage $V_C$ is supplied from an output terminal 12 of a constant-voltage circuit 4 as shown in FIG. 2, which is formed between and connected to a higher side voltage source 11 (for example, positive or ground voltage $V_{CC}$) and the lower side voltage source 10, and is constituted of NPN bipolar transistors $Q_2$ to $Q_5$ and resistors $R_3$ to $R_8$.

In the constant-voltage circuit 4 in FIG. 2, the constant voltage $V_C$ is generated based on the voltage of the lower side voltage source 10, that is, the level of the constant voltage output from the output terminal 12 depends on the voltage level at a portion of the lower side voltage source line 10 to which portion the constant-voltage circuit is connected. On the other hand, in the constant-current source 2 of FIG. 1, the constant current $I_{CS}$ is generated based on the voltage of the lower side voltage source 10, that is, the level of the constant current $I_{CS}$ flowing the transistor $Q_1$ depends on the voltage level at a portion of the lower side voltage source line 10 to which portion the corresponding constant-current source is connected.

Referring to FIG. 3, a conventional semiconductor integrated circuit will be explained. A bus line 31 of the lower side voltage $V_{EE}$ is formed along a peripheral straight edge line 5 of a semiconductor chip 20, and the voltage $V_{EE}$ is fed to the bus line 1 from terminal node 3 positioned at both end portions 31'' of the bus line 31. Also, constant-voltage circuits 4 are connected to the portions 31'' of the bus line 31, respectively, and between the constant-voltage circuits 4 a constant-current source group, in which a plurality of constant-current sources 2 are arranged along the bus line 1, is positioned. The constant-current sources 2 are connected to the corresponding portions of the bus line 31 through lines 22, respectively, and the constant voltage $V_C$ is fed from the output terminals 12 (FIG. 2) of the constant-voltage circuits 4 to the respective input terminals 9 (FIG. 1) of the constant-current sources 2 through a main wiring line 23 and branch wiring lines 24.

Returning to FIG. 1, the value of the constant current $I_{CS}$ supplied from the terminal 8 is determined by the potential difference between $V_C$ and $V_{EE}$, the base emitter forward voltage nature of the transistor $Q_1$ and the value of the resistor $R_1$, and base current $I_b$ calculated by $I_{CS}/h$, where h is current amplification factor of the transistor $Q_1$, flows the base of the transistor $Q_1$ as a load current of the constant-voltage circuit 2.

In FIG. 3, the constant voltage $V_C$ is supplied to a plurality of the constant-current sources 2 through the line 23 and lines 24 from two of the constant-voltage circuits 4, and the value of the constant voltage $V_C$ is deviated at every portion of the main line 23 i.e. at every constant-current source 2 by the voltage drop due to the load current $I_b$ (FIG. 1), as indicated by the characteristic curve 6 of $V_C$ in FIG. 4. Namely, the value of $V_C$ become lower as remoter from the constant-voltage circuits 4, and from the end portions 23'' to the middle portion 23' of the wiring 23 the $V_C$ is reduced by $\Delta V_C$.

On the other hand, the level of the lower side voltage $V_{EE}$ is deviated at every portion of the bus line 31 to which portion the corresponding constant-current source is connected. The deviation of $V_{EE}$ is caused by the voltage drop due to the constant current $I_{CS}$ entering into and flowing within the bus line 31, as indicated by the characteristic curve 7 of $V_{EE}$ in FIG. 4. Namely, the value of $V_{EE}$ becomes higher as remoter from the terminal nodes 3 positioned at end portions 31'' of the bus line 31, and from the end portions 31'' to the middle portion 31' of the bus line 31 the $V_{EE}$ is increased by $\Delta V_{EE}$.

As mentioned above, in the prior art, at a portion (at one constant-current source) where the $V_C$ rises, the $V_{EE}$ falls, and vice versa, and the constant current $I_{CS}$ is determined by the voltage difference between $V_C$ and $V_{EE}$ when the resistance of the resistor $R_1$ is constant. Therefore, the value of the constant current $I_{CS}$ is largely deviated by the position where the constant-current source is formed. For example, when the voltage drop of $V_C$ in the main wiring line 23 is about 10 mV ($\Delta V_C$), and the voltage rise of $V_{EE}$ in the bus line 31 is about 30 mV ($\Delta V_{EE}$, the deviation of the maximum voltage difference between $V_C$ and $V_{EE}$ becomes about 40 mV. Consequently, the deviation of the value of the constant current $I_{SC}$ due to the position of the constant current source formation becomes about 10% among the plurality of the constant current sources arranged in one direction, when the voltage difference between $V_C$ and $V_{EE}$ is 1.2 V where both of the voltage drop and the voltage rise by the wiring lines do not exist, and the base-emitter forward voltage of the transistor $Q_1$ (FIG. 1) is 0.8 V.

In the conventional semiconductor integrated circuit, accordingly, a depression of a margin on logic threshold value is inevitable, and in case a sufficient margin is designed, the operation speed is decreased.

SUMMARY OF THE INVENTION

Accordingly, it is an object of the present invention to provide a semiconductor integrated circuit in which a deviation of the value of the constant current among a plurality of constant-current sources is small.

According to the present invention, there is provided a semiconductor integrated circuit which comprises a bus line having single or plural first nodes for supplying a power source voltage to the bus line, and having single or plural second nodes; single or plural constant-voltage circuits connected to the single or plural second nodes of the bus line; a plurality of constant-current sources arranged along the bus line and connected to the bus line at their respective positions; and a wiring connecting the single or plural constant voltage circuits and the constant-current sources to supply a constant voltage from the single or plural constant voltage circuits to the constant-current sources to control the level of the constant current in the constant-current sources. The positions of the first and second nodes of the bus line is determined such that the deviation of the level of the constant current among the constant-current sources becomes small. The deviation is caused by a voltage variation of the power source voltage at every portion of the bus line due to current flowing the bus line and by a voltage variation of the control voltage at every portion of the wiring due to current flowing the wiring.

DESCRIPTION OF THE EMBODIMENTS

Figure 1:
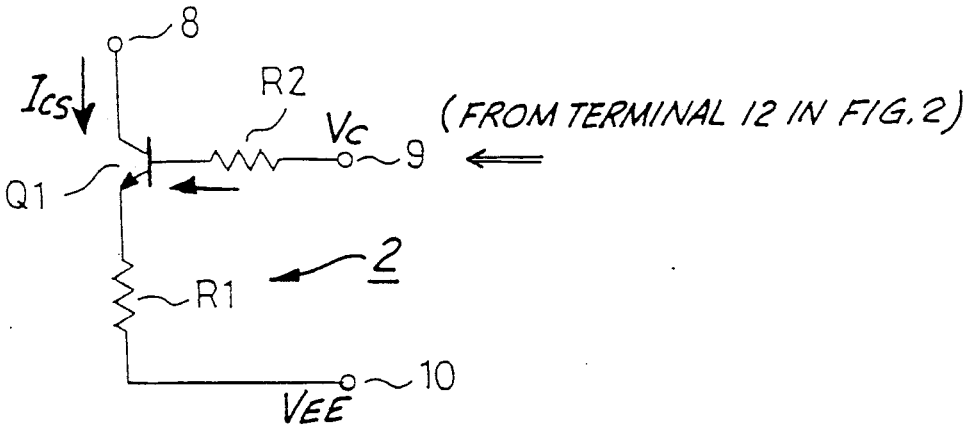
FIG. 1 is a circuit diagram showing a constant-current source.
Figure 2:
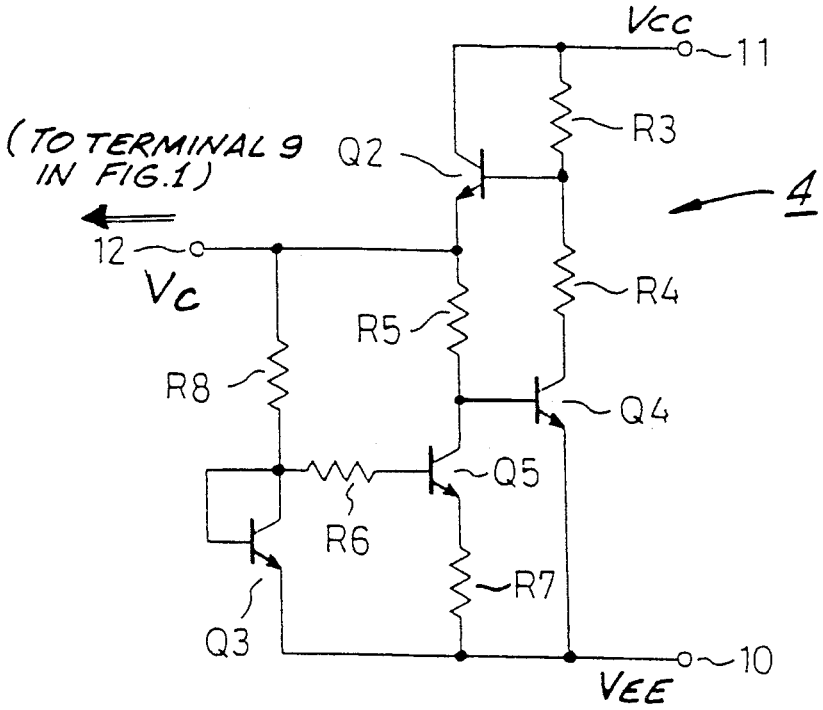
FIG. 2 is a circuit diagram showing a constant-voltage circuit.
Figure 5:
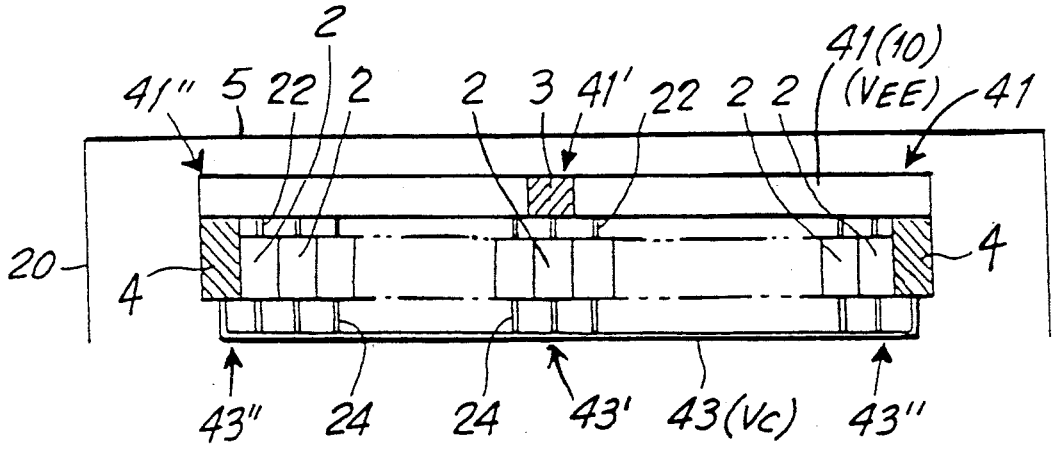
FIG. 5 is a schematic plan view of a first embodiment of the present invention showing the arrangement of constant-voltage circuits and a $V_{EE}$ terminal node of the bus line from which $V_{EE}$ voltage is supplied to the bus line.

Referring to FIG. 5 showing a first embodiment, a bus line 41 of the lower side power voltage $V_{EE}$ is formed along the straight edge line 5 of the semiconductor chip 20. The terminal node 3 is positioned at a middle portion 41' of the bus line 41, and through a bonding pad (not shown in FIG. 5) which is formed between the edge line 5 and the bus line 41, the $V_{EE}$ voltage is supplied to the terminal node 3 (middle portion 41'). Both end portions 41" of the bus line 41 are nodes to which the constant-voltage circuits 4 are connected, respectively. Between the constant-voltage circuits 4, a plurality of constant-current sources 2 are arranged along the bus line 41 and along the edge line 5, and each of the constant-current sources 2 is connected to the corresponding portion of the bus line 41 through wiring 22 at its terminal 10 (FIG. 1). A main wiring line 43 is formed along the bus line 41 and along the arrangement of the constant-current sources 2 and is connected to the output terminal 12 (FIG. 2) of the constant-voltage circuits 4, respectively, and each of the constant-current sources 2 is connected to the corresponding portion of the main line 43 of $V_C$ through a branch wiring line 24 at its terminal 9 (FIG. 1) so that the control voltage $V_C$ is supplied to every constant-current source 2.

Figure 3:
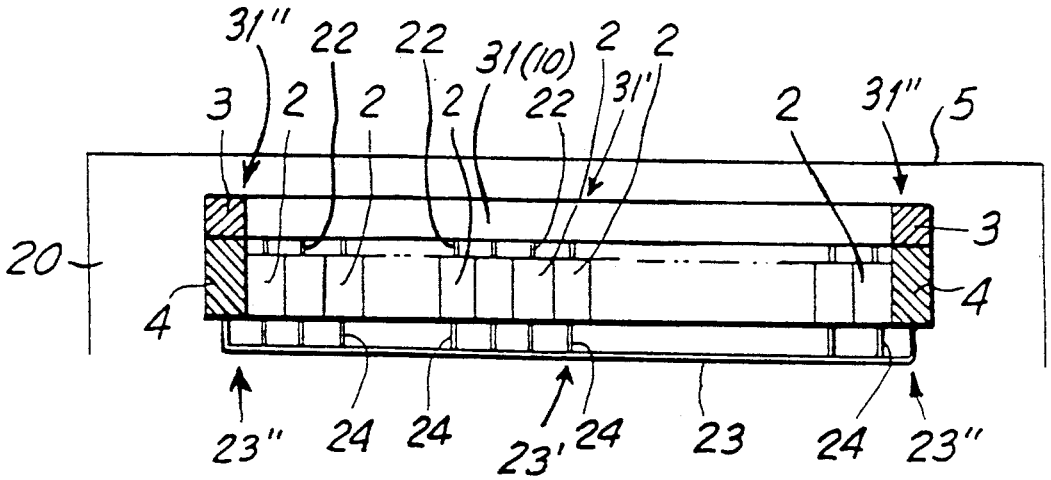
PRIOR ART FIG.3
FIG. 3 is a schematic plan view of a conventional semiconductor integrated circuit showing the arrangement of constant-voltage circuits and $V_{EE}$ terminal nodes of the bus line from which $V_{EE}$ voltage is supplied to the bus line.
Figure 4:
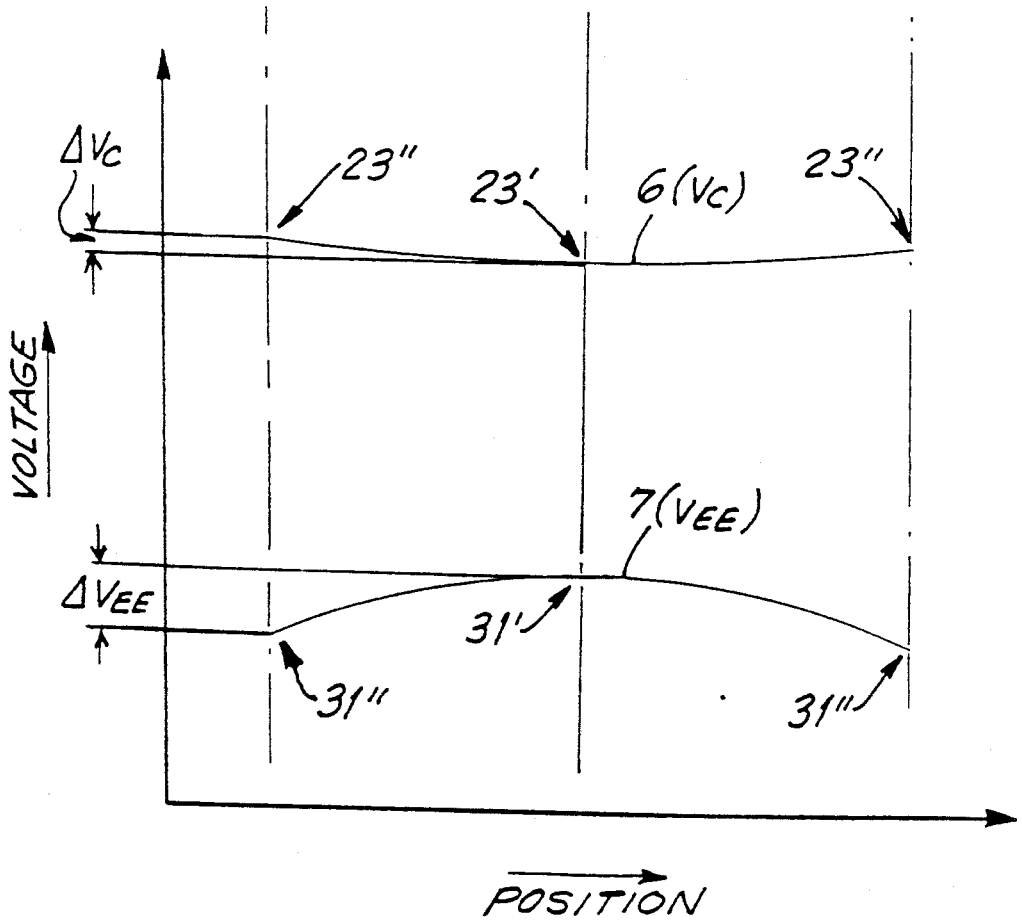
FIG. 4 is a diagram showing characteristics of $V_C$ and $V_{EE}$ with respect to positions of the arrangement in the conventional semiconductor integrated circuit shown in FIG. 3.

As described before, the voltage $V_C$ is lower as remoter from the constant-voltage circuit. In FIG. 5, the constant-voltage circuit 4 are installed at both ends as in the prior art of FIG. 3. Therefore, the potential ($V_C$) distribution in the wiring line 43 has a concavity shape as represented by a characteristic curve 16 of $V_C$ in FIG. 6; the same shape as of $V_C$ in the prior art of FIG. 4. That is, $V_C$ is gradually decreased from the end portion 43" of the main wiring line 43 toward the middle portion 43' thereof by $\Delta V_C$.

On the other hand, the voltage $V_{EE}$ is higher as remoter from the terminal node of the bus line from which $V_{EE}$ is supplied. In FIG. 5, only one terminal node 3 is positioned at the middle portion 41' of the bus line 41. Therefore, the potential ($V_{EE}$) distribution in the bus line 41 has a concavity shape as represented by a characteristic curve 17 of $V_{EE}$ in FIG. 6; just opposite shape to $V_{EE}$ in the prior art of FIG. 4. That is, $V_{EE}$ is gradually decreased from the end portion 41" of the bus line 41 toward the middle portion 41' thereof by $\Delta V_{EE}$.

Both of $V_C$ and $V_{EE}$ have concavity shapes along the position, and therefore, the deviation of the voltage difference between $V_C$ and $V_{EE}$ at every portion becomes small. Consequently, the value of the constant current $I_{SC}$ in the constant-current source 2 can be suppressed its deviation among the plurality of the constant-current sources 2 arranged along the bus line 41 and along the main wiring line 43. For example, when $\Delta V_C$ is about 10 mmV and $\Delta V_{EE}$ is about 30 mV in FIG. 6, the deviation of the difference between $V_C$ and $V_{EE}$ becomes about 20 mV at the maximum value. Consequently, the deviation of the value of the constant current $I_{SC}$ due to the position of the constant current source formation can be reduced to about 5% at its maximum among the plurality of the constant current sources arranged in one direction, when the voltage difference between $V_C$ and $V_{EE}$ is 1.2 V where both of the voltage drop and the voltage rise by the wiring lines do not exist, and the base-emitter voltage of the transistor $Q_1$ (FIG. 1) is 0.8 V. The deviation in $I_{SC}$ of 5% is about a half value of that of the prior art structure in which the deviation in $I_{SC}$ becomes about 10%.

Figure 6:
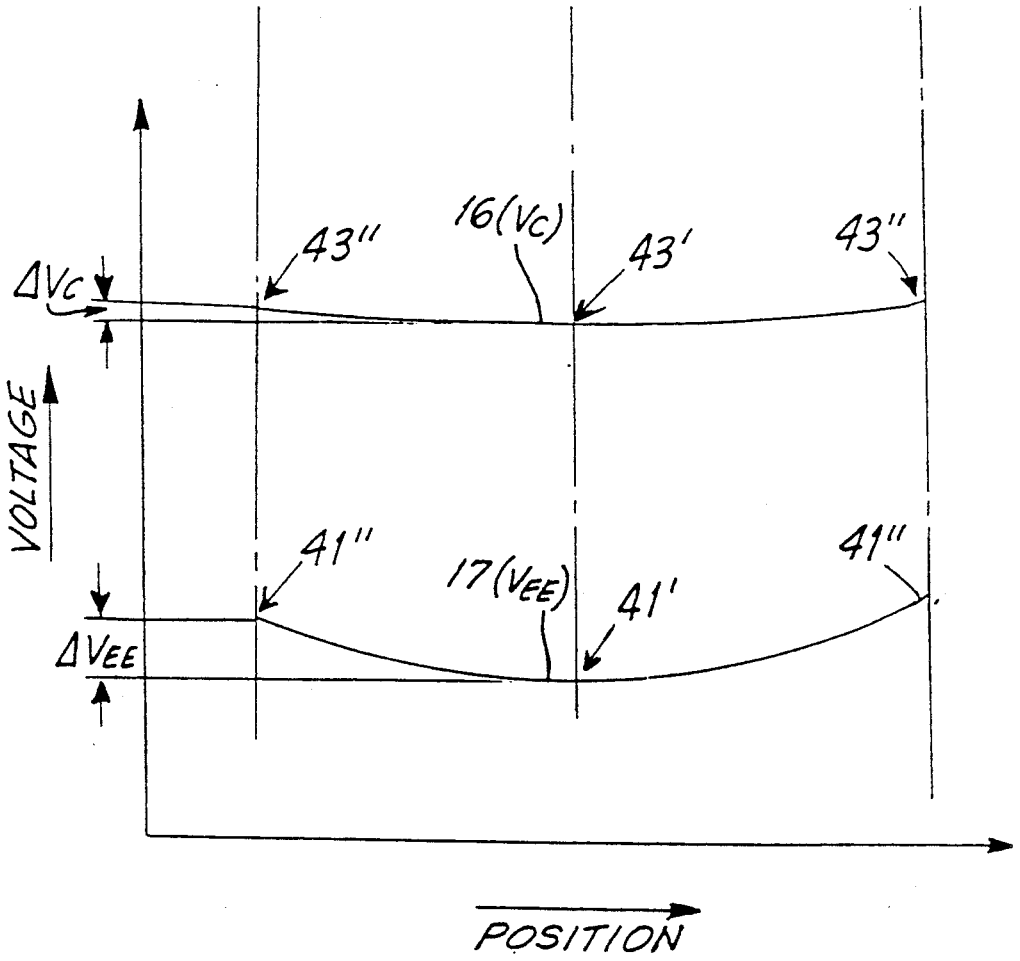
FIG. 6 is a diagram showing characteristics of $V_{CC}$ and $V_{EE}$ with respect to positions of the arrangement in the first embodiment shown in FIG. 5.
Figure 7:
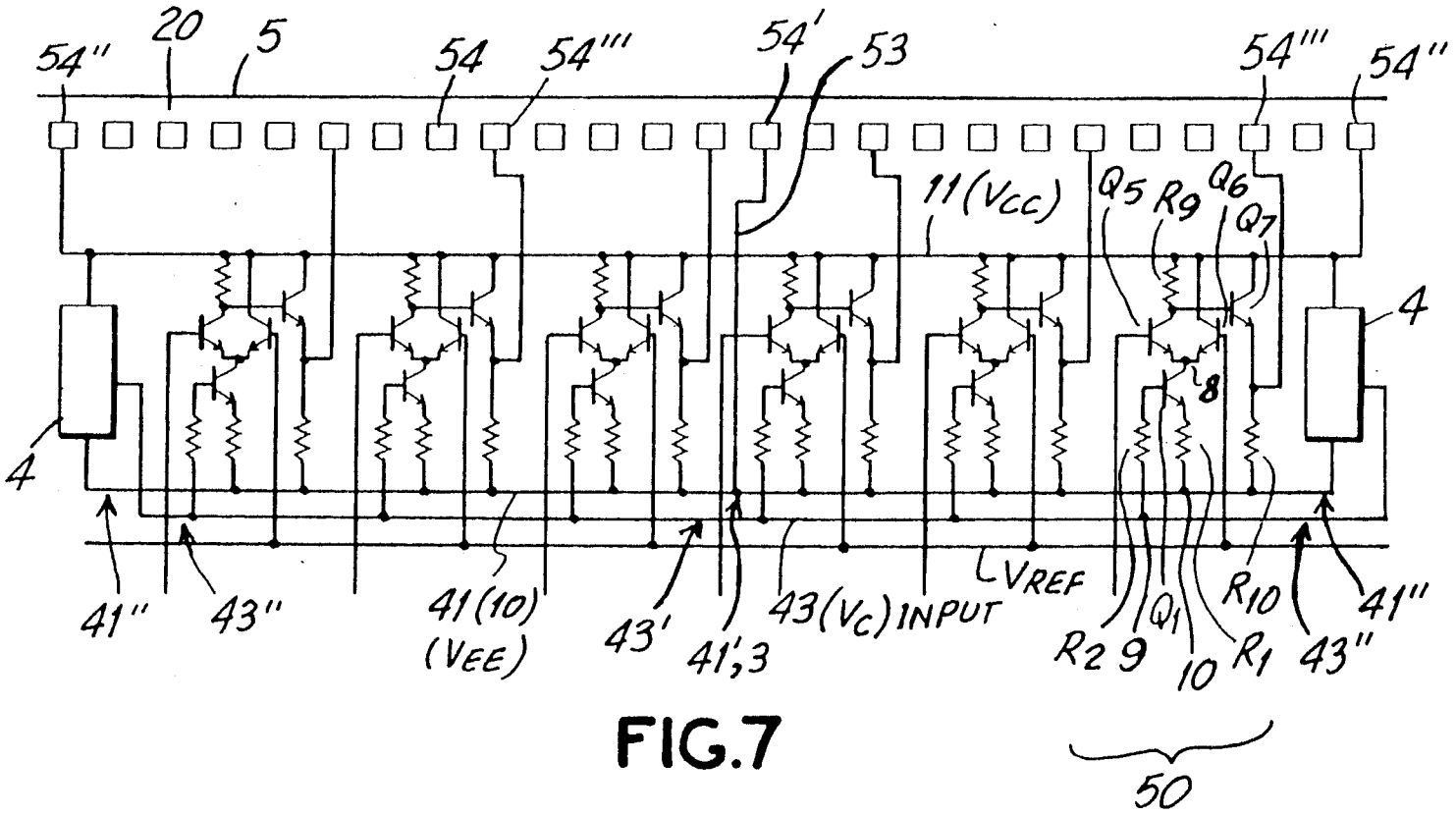
FIG. 7 is a plan view including a circuit diagram showing an embodified structure of the first embodiment of the present invention.

Referring to FIG. 7, the first embodiment is explained using a circuit diagram and a bonding pad arrangement. In FIG. 7, the same components as those in FIGS. 1, 5 and 6 are indicated by the same reference numerals. A plurality of bonding pads 54 including 54', 54" and 54"' are arranged along the straight edge line 5 of the semiconductor chip 20. The terminal pad 3 positioned at the middle portion 41' of the bus line 41 is electrically connected to the bonding pad 54' through a wiring layer 53. The higher side power supply voltage line 11, that is, $V_{CC}$ line extends along the edge line 5 and is electrically connected to bonding pads 54". At the left and right end portions, the constant-voltage circuits 4 are formed, respectively, and between the left side constant-voltage circuit 4 and the terminal node 3 of the middle portion and between the right side constant-voltage circuit 4 and the terminal node 3, three ECL unit cells 50 are formed, respectively. Each of the ECL unit cells 50 is composed of the constant-current source, an emitter coupled circuit coupled to the constant-current source, and an emitter follower circuit coupled to the emitter coupled circuit. The constant-current source is constituted of the NPN bipolar transistor $Q_1$ and resistors $R_1$, $R_2$ as shown in FIG. 1; the emitter coupled circuit is constituted of an NPN bipolar transistor $Q_5$ input at its base an input signal "INPUT", an NPN bipolar transistor $Q_6$ input at its base a reference voltage "$V_{REF}$" and a resistor $R_9$; the emitter follower circuit is constituted of an NPN bipolar transistor $Q_7$ and a resistor $R_{10}$ and output the output signal to the bonding pad 54'''.

Figure 8:
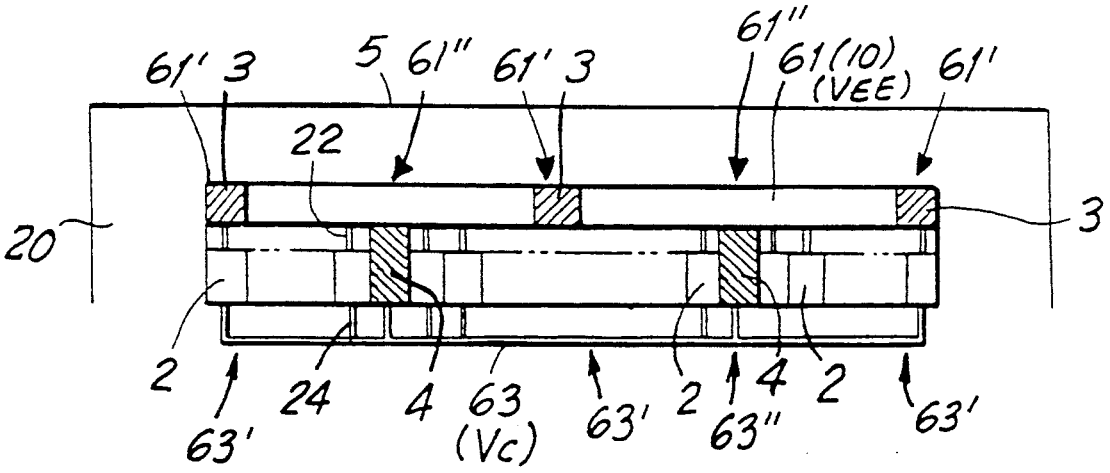
FIG. 8 is a schematic plan view of a second embodiment of the present invention showing the arrangement of constant-voltage circuits and $V_{EE}$ terminal nodes of the bus line from which $V_{EE}$ voltage is supplied to the bus line.
Figure 9:
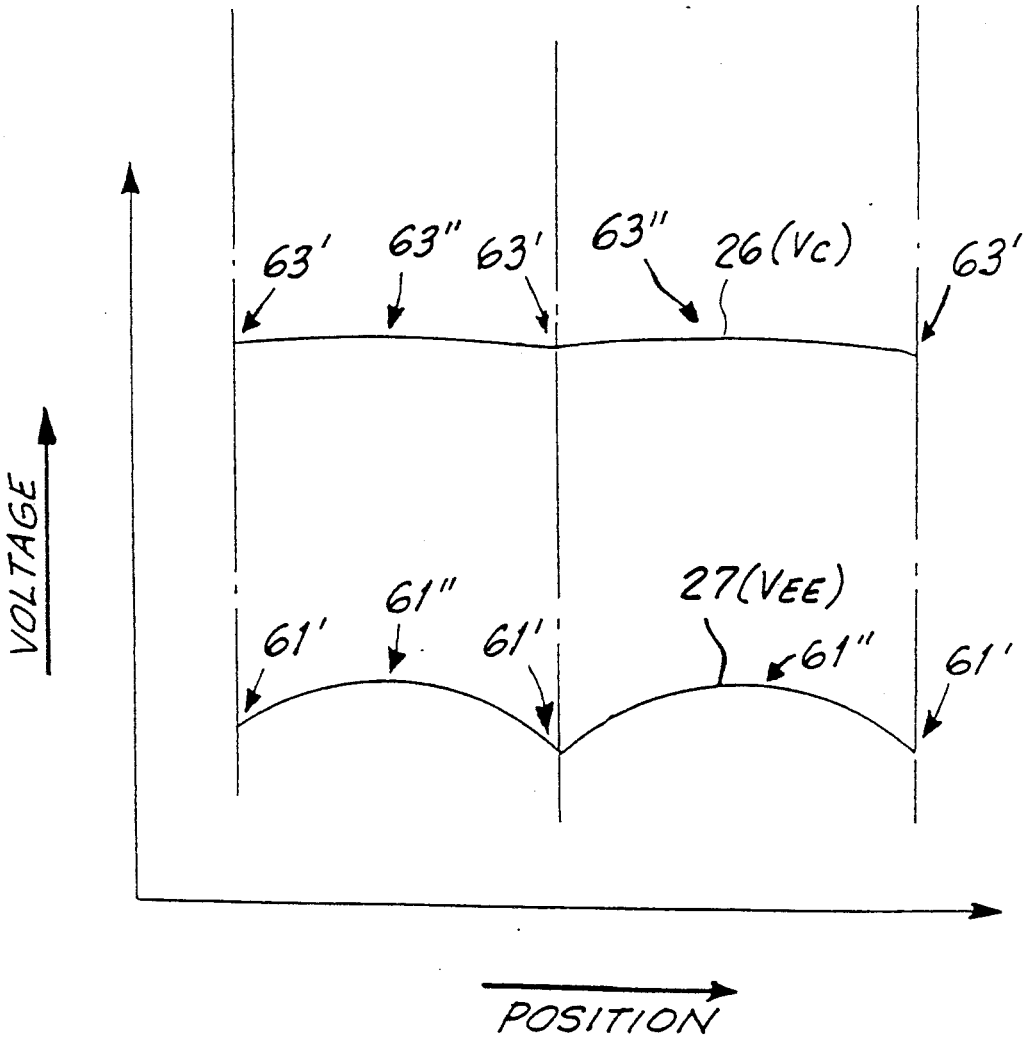
FIG. 9 is a diagram showing characteristics of $V_{CC}$ and $V_{EE}$ with respect to positions of the arrangement in the second embodiment shown in FIG. 8.
Figure 10:
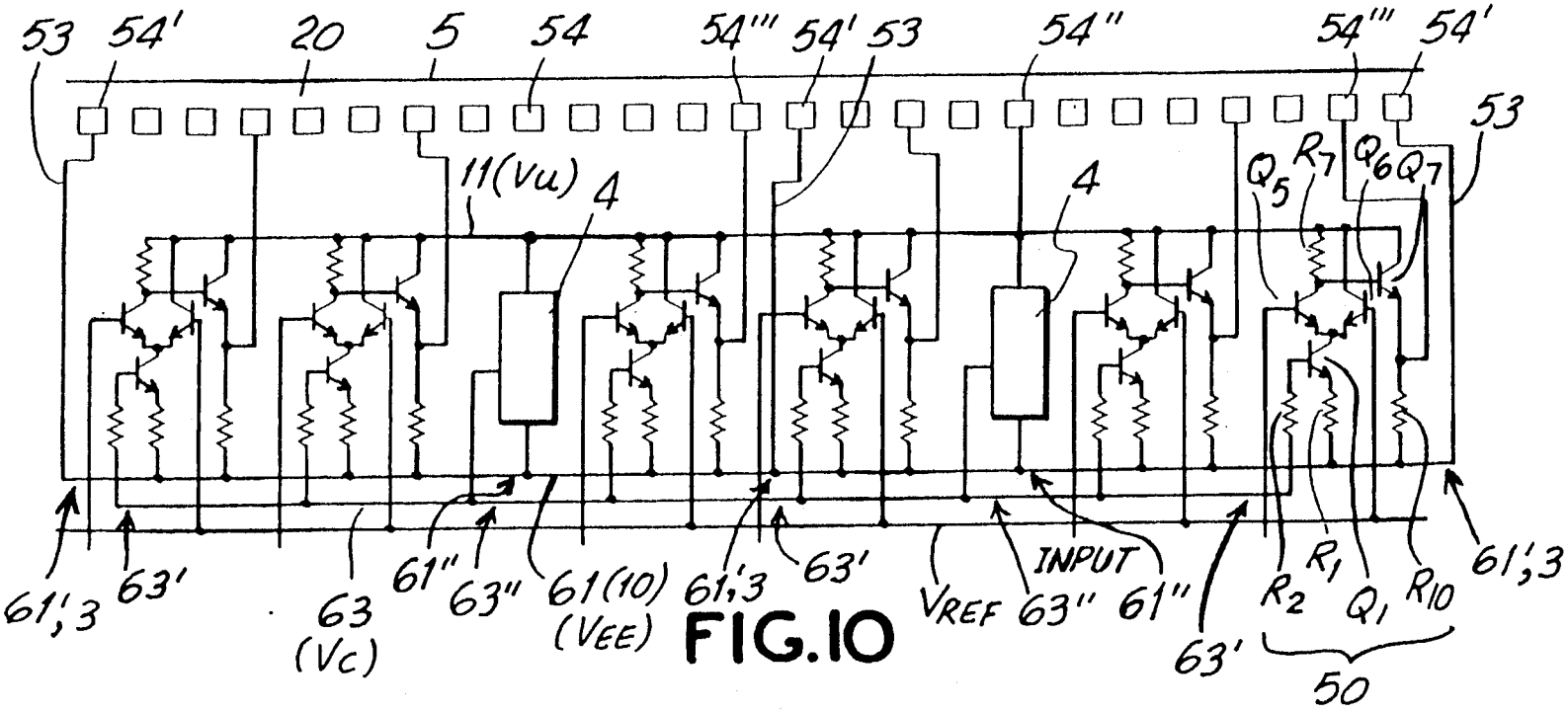
FIG. 10 is a plan view including a circuit diagram showing an embodified structure of the second embodiment of the present invention.

Referring to FIGS. 8 to 10, a second embodiment of the present invention will be explained. In FIGS. 8 to 10, the same component as those in FIGS. 5 to 7 are indicated by the same reference numerals.

Three terminal nodes 3 of a bus line 61 from which the $V_{EE}$ is supplied are positioned at the middle and end portions 61' of the bus line 61. Therefore, the potential distribution of $V_{EE}$ in the bus line 61 becomes as represented by a characteristic curve 27 ($V_{EE}$) in FIG. 9. That is, from the middle portion 61' and both end portions 61', the $V_{EE}$ is gradually increased to middle parts 61'' between the middle portion 61' and both end portions 61', respectively, so that two convexity shapes are formed.

The constant-voltage circuits 4 are electrically connected to the middle parts 61'' of the bus line, respectively. Therefore, in a main wiring layer 63 for transmitting the $V_C$, the $V_C$ becomes maximum value at the parts 63'' near the constant-voltage circuit 4 and minimum value at the middle and end portions 63''. Therefore, as curve 27 ($V_{EE}$), a characteristic curve 26 of $V_C$ has two convexity shapes as shown in FIG. 9.

Both characteristics curves 26, 27 of $V_C$ and $V_{EE}$ of the second embodiment have the same tendency from each other with respect to their positions as in the first embodiment. Therefore, the deviation of the constant current $I_{SC}$ among the constant-current sources 2 can be small, as in the first embodiment.

The second embodiment is favorable comparing to the first embodiment in case of power source current being large, because plural terminal nodes for supplying the voltage $V_{EE}$ to the bus line are installed.

In a special case in which only one terminal node of $V_{EE}$ and only one constant-voltage circuit are installed to one bus line, the terminal node is formed at one end portion of the bus line and the constant-voltage circuit is electrically connected to the other end portion of the bus line opposite to the one end portion.

As mentioned above, according to the present invention, a value of a constant current $I_{SC}$ can hardly depend on a position where the constant-current source is formed. Because a portion of a bus line to which a constant-voltage circuit is connected and a portion of a bus line from which a power source voltage $V_{EE}$ is supplied to the bus line are determined such that the voltage drop of the constant voltage $V_C$ and the voltage rise of the voltage $V_{EE}$ are compensated to each other so as to reduce a deviation of the difference between $V_C$ and $V_{EE}$ among a plurality of constant-current sources.

Therefore, the bipolar transistor type semiconductor integrated circuit of the present invention can prevent to decrease a margin to a logic threshold value.

What is claimed is:

1. A semiconductor integrated circuit comprising:

a bus line having single or plural first nodes for supplying a power source voltage to said bus line, and having single or plural second nodes;

single or plural constant-voltage circuits electrically connected to said single or plural second nodes of said bus line;

a plurality of constant-current sources arranged along said bus line and electrically connected to said bus line at their respective positions; and a wiring electrically connecting said single or plural constant voltage circuits and said constant-current sources to supplying a constant voltage from said single or plural constant voltage circuits to said constant-current sources to control the level of the constant current in said constant-current sources, wherein, the positions of said first and second nodes of said bus line is determined such that the deviation of the level of said constant current among said constant-current sources becomes small, which deviation is caused by a voltage variation of said power source voltage at every portion of said bus line due to current flowing said bus line and by a voltage variation of said control voltage at every portion of said wiring due to current flowing said wiring.

2. A semiconductor integrated circuit of claim 1, in which said single or plural first nodes and said single or plural second nodes are positioned at portions of said bus line different from each other.

3. A semiconductor integrated circuit of claim 1, in which said second nodes are positioned at both end portions of said bus line, and said first node is positioned between said end portions.

4. A semiconductor integrated circuit of claim 1, in which said first node is positioned at a middle portion of said bus line.

5. A semiconductor integrated circuit of claim 1, in which said first nodes are positioned at both end portions of said bus line and at a middle portion of said bus line, and said second nodes are positioned between said first nodes, respectively.

6. A semiconductor integrated circuit of claim 5, in which said second nodes are positioned at middle parts between said first nodes, respectively.

7. A semiconductor integrated circuit of claim 1 further comprising a plurality of bonding pads arranged along a straight edge of the semiconductor chip, and said bus line extends along said straight edge of said semiconductor chip.

8. A semiconductor integrated circuit of claim 7, in which first and second nodes are electrically connected to corresponding said bonding pads, respectively.

9. A semiconductor integrated circuit of claim 1, in which each of said constant-current source constitutes an ECL unit cell with an emitter coupled circuit and an emitter follower circuit.

* * * * *